US005840396A

United States Patent [19]

Betz

[11] Patent Number: 5,840,396

[45] Date of Patent: Nov. 24, 1998

[54] APPARATUS AND METHOD FOR FIXEDLY ATTACHING PROTECTIVE SURFACE COVERS TO STRUCTURAL SUBSTRATES

[76] Inventor: Richard T. Betz, 2141 N.W. Pacific Yew Pl., Issaquah, Wash. 98027

[21] Appl. No.: 586,548

[22] Filed: Jan. 16, 1996

Related U.S. Application Data

[63] Continuation-in-part of Ser. No. 245,445, May 18, 1994, Pat. No. 5,587,218.

[51] Int. Cl.[6] ..... B44C 1/26

[52] U.S. Cl. ..... 428/67; 52/179; 52/181; 428/119; 428/120; 428/131; 428/156

[58] Field of Search ..... 428/67, 40.1, 131, 428/119, 120, 156; 52/179, 181

[56] References Cited

U.S. PATENT DOCUMENTS

| | | | |
|---|---|---|---|
| 334,994 | 1/1886 | Spadone | 52/179 |
| 481,702 | 8/1892 | Mason et al. | 52/181 |
| 1,561,668 | 11/1925 | Stanwood | 52/179 |
| 3,353,315 | 11/1967 | Barker | 52/275 |
| 3,565,737 | 2/1971 | Lefevre et al. | 161/36 |
| 4,029,354 | 6/1977 | Valeri | 296/28 D |
| 4,804,570 | 2/1989 | Bedics | 428/53 |
| 4,855,174 | 8/1989 | Kawamoto | 428/67 |
| 4,998,391 | 3/1991 | Connew | 52/179 |
| 5,103,608 | 4/1992 | Andreo | 52/179 |

OTHER PUBLICATIONS

Balco Metalines, product brochure 05723/BAL, BuyLine 3111, undated.

Balco, Inc., Safety Tread Two Component Stair Nosings product catalog No. N14 1984 5.13b/BaL, Aug. 1978.

*Primary Examiner*—Nasser Ahmad

*Attorney, Agent, or Firm*—Seed and Berry, LLP

[57] ABSTRACT

The present invention provides a series of protective covers and a method for attaching the protective covers to a structural substrate. The series of covers includes a temporary cover that is made from a relatively inexpensive material, and a permanent protective cover that has finished surfaces. The temporary cover has a base, removable fasteners coupled to the base, and anchors coupled to the fasteners. The permanent cover has a permanent base element and fasteners attached to the element. The temporary cover is removably attached to the structural substrate during construction of the subject building. When the structural substrate is cement, the temporary cover forms a contoured region in the cement that matches the profile of the temporary cover. After the construction of the facility is finished, the temporary cover is removed from the structural substrate, leaving the contoured region and the anchors in the structural substrate. The permanent cover, which is shaped to mate with the contoured region, is then fixedly attached to the anchors and the surfaces of the contoured region.

13 Claims, 7 Drawing Sheets

APPARATUS AND METHOD FOR FIXEDLY ATTACHING PROTECTIVE SURFACE COVERS TO STRUCTURAL SUBSTRATES

RELATED APPLICATION

This is a continuation-in-part of application Ser. No. 08/245,445, filed on May 18, 1994 now U.S. Pat. No. 5,587,218, and entitled "Improved Surface Covering."

TECHNICAL FIELD

The present invention is directed toward an apparatus and method for fixedly attaching protective covers to pedestrian traffic areas and other structural substrates; more particularly, the invention is directed toward tread materials that enhance the safety, durability, and appearance of the surfaces of such areas.

BACKGROUND OF THE INVENTION

Pedestrian traffic areas such as stairs, walkways, entryways, and decks commonly require protective surface covers that should do the following: (1) comply with applicable laws (e.g., building codes and the American With Disabilities Act); (2) enhance the safety of the area to limit liability for slip and fall accidents; (3) install easily and require little maintenance; (4) look aesthetically pleasing; and (5) reduce costs and have long service lives. Many covers for structural substrates are currently available, one of which that meets all of these criteria is described in applicant's co-pending application entitled "Improved Surface Covering," Ser. No. 08/245,445.

Conventional surface covers for stairways, commonly called nosings, are often used in commercial and public facilities where there is a significant amount of pedestrian traffic. Conventional nosings cover the front portion of stairs, and they are made from a multitude of materials. Metal nosings are generally made from cast metals, such as iron, aluminum, bronze, and nickel, or extruded metals, such as aluminum or bronze. Nosings may also be made from other materials including vinyl or rubber treads, applied coatings (e.g., paints), high friction tapes, high friction tiles and carpet. The most popular nosings are made from extruded aluminum with strips of an abrasive tread material on their top surface. Extruded aluminum nosings are very expensive to manufacture because the abrasive material is initially a wet paste that is spread over the nosing, filling the grooves and forming an even layer that covers the top of the extruded piece. The abrasive material is then selectively scraped off in longitudinal lines between the grooves, leaving a slightly raised strip at each groove. After the abrasive material is selectively scraped off, excess abrasive material is cleaned from the aluminum surfaces between the raised strips, and the whole nosing is heated for several hours to cure the treads.

Nosings are typically categorized either as one-piece or two-piece nosings. Most extruded aluminum nosings are one-piece nosings with a single base member that is embedded in fresh concrete. One-piece nosings typically have an anchor formed integrally with, or attached separately to, the base member. Two-piece nosings have a lower base member that is embedded into fresh concrete, and an upper base number that is subsequently attached to the lower base member.

Nosings may be installed on stairs made from concrete, metal, wood, or other suitable materials. On new construction of concrete stairs, metal nosings are floated on wet concrete shortly after it is poured until they are flush with both the top surface and the front lip of each stair. The anchors extending from the bottom surface of the nosings permanently attach the nosing to the concrete. Accordingly, one-piece nosings are often damaged during construction, rendering them unsightly and causing a serious problem for the contractors.

When two-piece nosings are installed in a building, the lower member is imbedded in the wet concrete and then covered with a temporary protective material such as plywood or other rigid material. After construction is completed, the temporary protective material is removed and the upper member is attached to the lower member. Although conventional two-piece nosings may reduce the amount of damage to the finished product, the lower member of conventional two-piece nosings is a permanent fixture which itself can be damaged during the construction project to such an extent that it cannot receive the upper member.

Conventional one-piece and two-piece extruded aluminum nosings are also not readily available because they are too expensive for distributors to stock in large quantities for immediate shipment to construction sites. Conventional nosings are also difficult to cut, and thus they are usually manufactured "to order" in that they are individually cut to length and colored for specific construction projects. Moreover, it takes up to one month to manufacture "to order" nosings, so contractors that fail to order in advance often incur scheduling delays. The construction schedule for pouring concrete, therefore, is often delayed when extruded aluminum nosings are required.

Conventional protective covers for other structures such as floors, ramps, walkways, decks and walls must perform the same general function as nosings and meet the same general criteria. Protective covers for planar structures are often made from the same cast metals, extruded metals, plate materials, and safety treads that are used for nosings. Accordingly, the problems facing protective covers for planar structures are often the same as those facing stair nosings.

SUMMARY OF THE INVENTION

According to the principles of the present invention, a series of protective covers and a method for attaching the protective covers to a structural substrate are provided. The series of protective covers includes a temporary protective cover that is made from a relatively inexpensive material, and a permanent protective cover that has finished surfaces. The temporary and permanent covers of the present invention provide a system for covering a structural substrate that meets the general criteria for protective surface covers and offers several advantages over conventional one-piece and two-piece covers.

The temporary cover includes a base that has a top face, a bottom face, and a selected profile that either forms a contoured region in the substrate or mates with an existing contoured region. A fastener is provided that has an upper portion coupled to the base and a lower portion that extends beyond the base's bottom face. The lower portion of the fastener is positioned in a recess of an anchor and connected to the anchor.

The permanent cover includes a permanent element that has an upper surface, a lower surface and a channel positioned in at least a portion of the lower surface. The permanent element has a selected profile that mates with the contoured region in the substrate that was formed by the temporary cover. The channel in the lower surface has sidewalls extending from the lower surface to an intermediate point within the element. A fastener is provided that has a head portion positioned in the channel at a selected location, and a stud portion extending from the head to beyond the lower surface. The stud is positionable in a recess of an anchor that has been imbedded into the substrate and fixedly attached to the anchor.

In operation, the temporary cover is removably attached to the structural substrate during construction of the subject building. When the structural substrate is cement, the temporary cover is pressed into the cement while it is wet, forming a contoured region in the cement that matches the profile of the temporary cover. After the construction of the building is finished, the temporary cover is removed from the structural substrate, leaving the contoured region and the anchors in the structural substrate. The permanent cover, which is shaped to mate with the contoured region, is then fixedly attached to the anchors and the surfaces of the contoured region.

The series of covers of the present invention offers several advantages over conventional protective covers. First, the temporary cover is inexpensive to manufacture and, thus, it can be economically stocked in large quantities and readily available to contractors on short notice. Second, the permanent cover will be subject to very little damage because it is installed only after construction is finished. Third, the permanent cover looks better than conventional two-piece covers because it does not have any exposed fasteners. Lastly, neither the temporary cover nor the permanent cover allow voids to be present between the substrate and the abutting surfaces of the covers.

A method of the invention is a process of attaching a temporary protective cover to the substrate during the construction of a building. The temporary cover includes a base and a fastener that is coupled to the base such that an upper portion of the fastener is coupled to the base and a lower portion of the fastener extends beyond a bottom face of the base. An anchor is attached to the lower portion of the fastener such that the lower portion of the fastener is positioned in a recess in the anchor. The temporary protective cover is attached to the substrate by imbedding the anchor into the substrate so that the anchor and base are fixedly attached to the substrate.

A further embodiment of a method of the invention is a process for attaching a permanent protective cover to the substrate after a temporary cover has been removed. In this embodiment, the permanent cover has a permanent element with a selected profile that mates with a contoured region in the substrate that was left by the temporary cover, and a channel positioned in the lower surface of the permanent element. The channel has sidewalls extending from the lower surface to an intermediate point within the permanent element. The permanent cover includes a fastener that has a head inserted in the channel at a selected location and a stud that extends from the head to beyond the lower surface of the permanent element. The selected location of the stud is aligned with the recess in the anchor so that the permanent element is attached to the substrate by positioning the element in the contoured region and the stud in the recess of the anchor.

DETAILED DESCRIPTION OF THE INVENTION

FIGS. 1–14 illustrate a series of protective covers and a method for attaching the protective covers to a substrate in accordance with the invention. To better understand the present invention, it is helpful to first set forth the specific objectives that the protective covers should satisfy.

First, the fasteners that are used to attach the protective covers to the structure should not be exposed. Exposed fasteners are undesirable because they are not aesthetically pleasing and they tend to work loose over time from vandalism, thermal expansion/contraction, or vibrations. Second, there should not be any voids between the protective cover and the surface of the substrate. Water or other substances trapped in such voids under the covers damages the underlying substrate and contaminates the surrounding area. Third, damage that occurs to permanently attached covers during construction should be reduced. Since many protective covers, and especially stair nosings, are attached during the early stages of a construction project, they are often permanently damaged by tools and construction materials that are dropped onto or dragged across their surface. Fourth, protective covers should be cost effective to manufacture, supply, install, and maintain. Suppliers do not inventory conventional covers because they are expensive to manufacture, difficult to cut, and subject to color selection. Consequently, unless contractors order popular models of protective covers well in advance of the scheduled date for pouring concrete floors or stairs, they commonly cannot obtain the particular cover that was called for in the specifications in time to pour the concrete.

Figure 1:
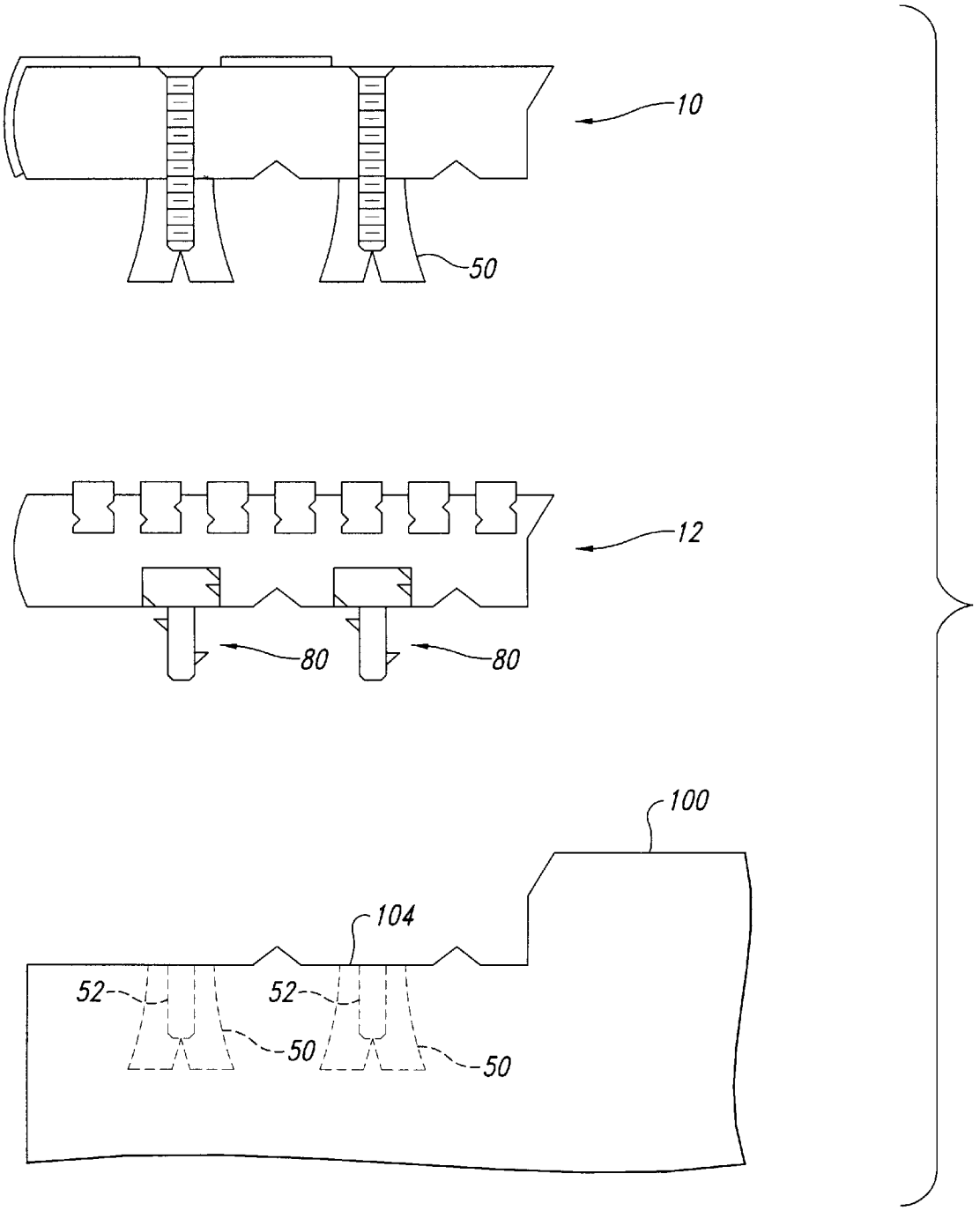
FIG. 1 is a cross-sectional view of a temporary cover and a permanent cover in accordance with the invention.

FIG. 1 illustrates a temporary cover 10 and a permanent cover 12 of the invention positioned with respect to a contoured surface 104 in a substrate 100. The temporary cover 10 is initially imbedded into the substrate 100 during the construction of the subject building. The temporary cover 10 either forms the contoured region 104 or mates with an existing contoured region. The temporary cover 10 remains imbedded in the substrate 100 throughout the construction period. After construction of the subject building is substantially complete, the temporary cover 10 is removed from the substrate 100, leaving the contoured region 104 and a number of anchors 50 in the substrate 100. The permanent cover 12, which has a profile that mates with the contoured region 104 and a number of non-exposed fasteners 80, is then fixedly attached to the surfaces of the contoured region 104 and the anchors 50. The fasteners 80 are selectively positioned along the permanent cover 12 to align with the anchors 50 so that the lower portions of the fasteners may be positioned in the recesses 52 of the anchors 50. Specific features of the invention and the advantages are more fully described herein.

Figure 2:
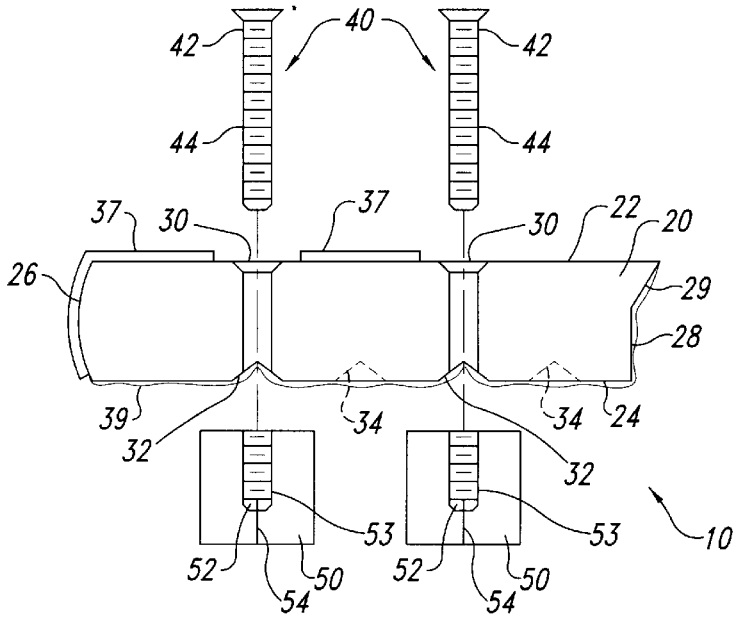
FIG. 2 is a cross-sectional view of a temporary cover assembly in accordance with the invention.
Figure 3:
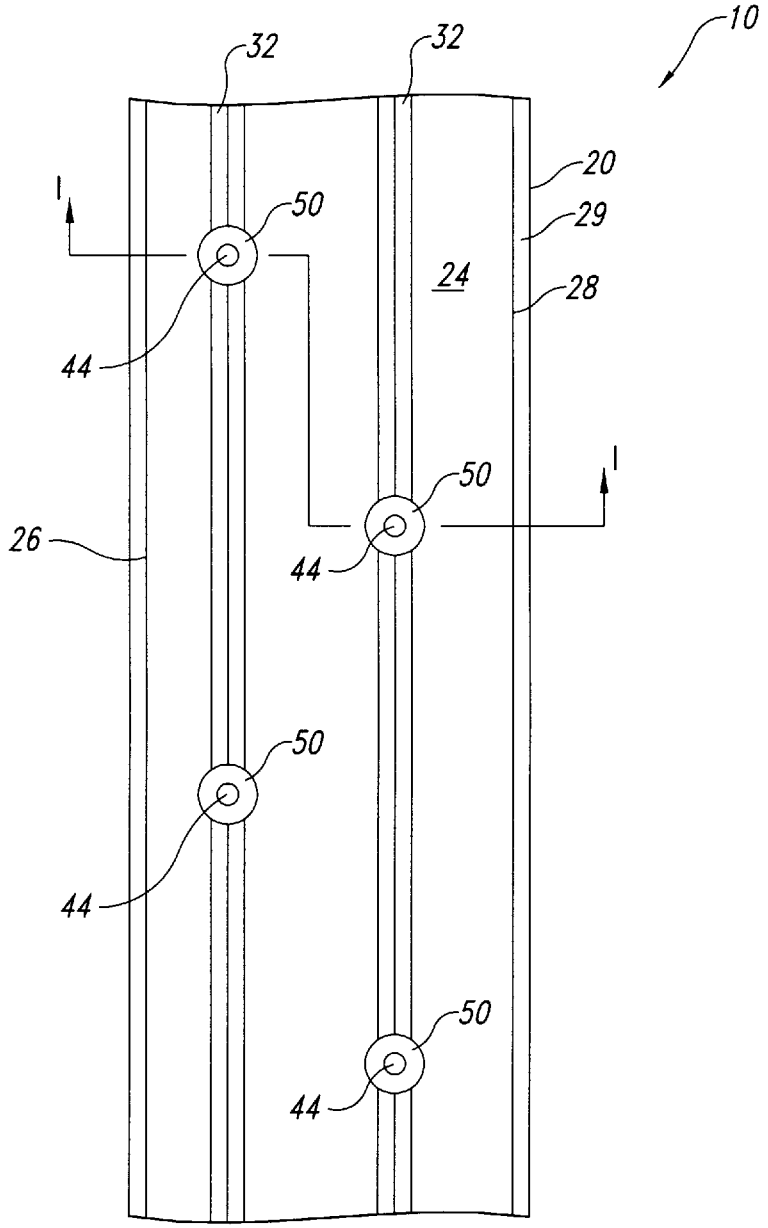
FIG. 3 is a bottom view of the temporary cover shown in FIG. 2.

FIGS. 2 and 3 further illustrate the temporary cover 10 embodying a temporary stair nosing that has a prefabricated base 20, a fastener 40, and an anchor 50. The base 20 has a selected profile defined by its top face 22, bottom face 24, front face 26, and rear face 28. The rear face 28 may extend straight along the full height of the base 20, or, alternatively, an inclined lip 29 may extend upwardly at an angle from its rear face 28 to its top face 22. A number of holes 30 extend through the base 20 from its top face 22 to its bottom face 24. The holes 30 are aligned along two spaced-apart longitudinal channels 32 extending along the bottom face 24 (best shown in FIG. 3). The invention is not limited to a specific number or configuration of holes and channels. As such, separate channels 34 (shown in phantom) may be positioned on another part of the bottom face 24 out of alignment with the holes 30. A high-friction tape 37 is preferably attached to the top and front faces 22 and 26, and an anti-stick compound 39 is preferably spread along the bottom and rear faces 24 and 28.

The base 20 is preferably made from extruded plastic. In one embodiment, the base 20 is made from reclaimed plastics that would otherwise have been disposed of in landfills or other waste depositories. The grooves 32 or 34 are formed in the base 20 by the manufacturer as it is extruded, and the holes 30 are formed in the base 20 by the manufacturer after it cools. The high friction tape 37 is attached to the base 20 either before or after the holes 30 are formed in the base 20. If the high friction tape 37 is attached before the holes 30 are formed, then the holes 30 are simply drilled through the tape 37 as well. In another embodiment, the high friction tape 37 is replaced by serrated ridges (not shown) formed on the upper surface of the base 20. The serrated ridges are preferably extruded into treads along the upper surface of the base 20.

A number of fasteners 40 are coupled to the base 20, after it is formed. Each fastener 40 has an upper portion 42 that is coupled to the base 20 and a lower portion 44 that extends beyond the lower surface 24. In the embodiment of the invention shown in FIG. 2, the upper portions 42 of the fasteners 40 are coupled to the base 20 by positioning them in corresponding holes 30.

An anchor 50 is attached to each fastener and, thus, a number of anchors are attached the base 20. Each anchor 50 has a wall 53 defining a recess 52, and a slit 54. The slits 54 allow the anchors to expand radially as the fasteners 40 are positioned in the recesses 52.

Figure 4:
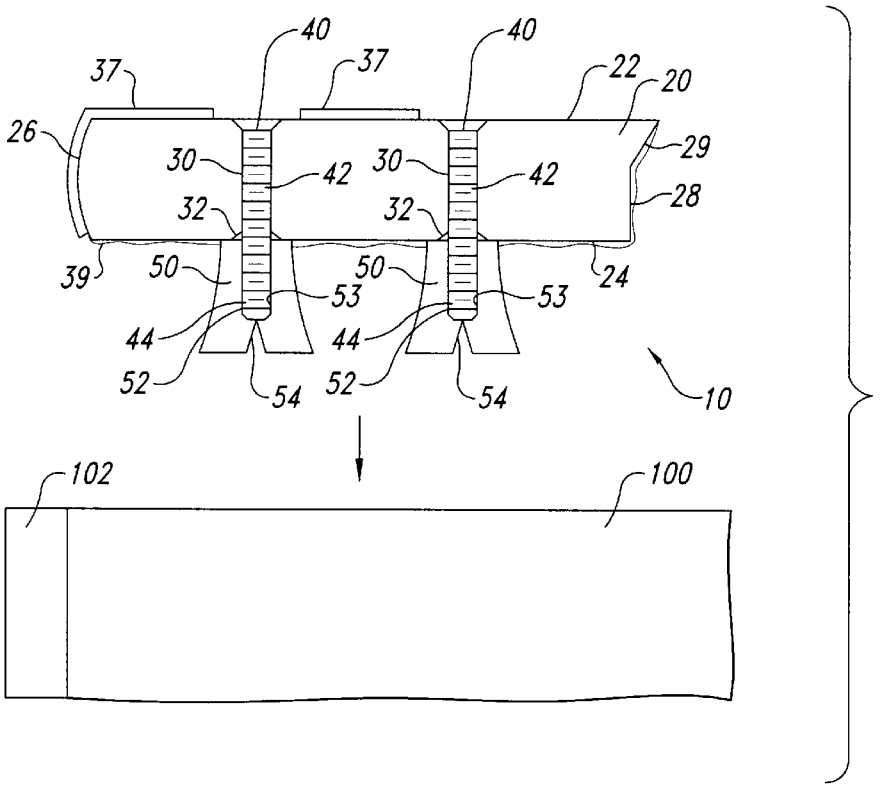
FIG. 4 is a cross-sectional view of a substrate and an assembled temporary cover ready for insertion into the substrate in accordance with the invention.
Figure 5:
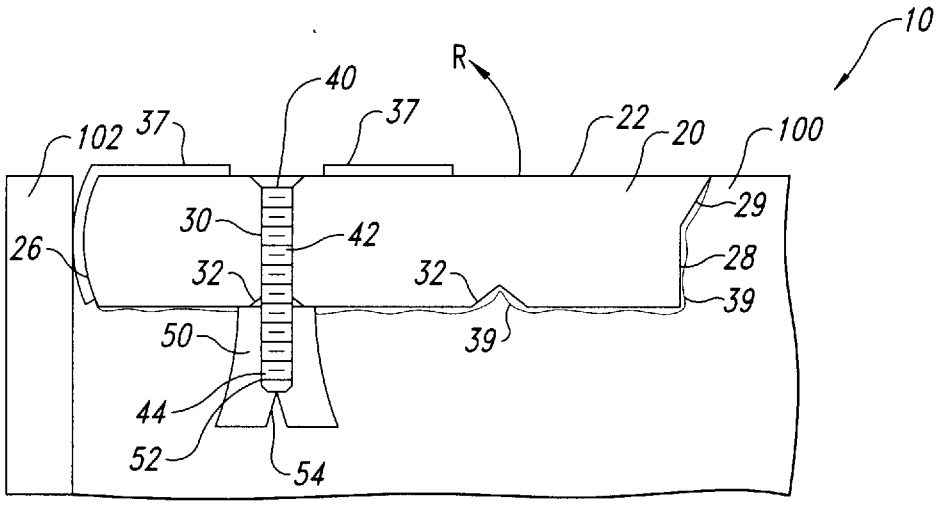
FIG. 5 is a cross-sectional view of a temporary cover in accordance with the invention temporarily imbedded in a substrate.

FIG. 4 illustrates an assembled temporary cover 10 in which the anchors 50 are attached to the base 20 before they are imbedded into the substrate 100. Each anchor 50 is securely attached to the base 20 by threadedly engaging the lower portion 44 of the fastener 40 to the wall 53 of the recess 52. For the purposes of illustration, the substrate 100 depicted in FIG. 4 is a wet concrete step that has just been poured into a form 102. The assembled temporary cover 10 is then pressed into the wet concrete 100, as shown in FIG. 5. The temporary cover 10 displaces the wet cement 100, thereby forming the wet cement into the shape of the abutting surfaces of the temporary cover 10. The cement 100 may be poured to the top of the lower forms and allowed to partially cure so that it does not flow over the lower forms when the temporary cover is pressed into place. The temporary cover may also be attached to the lower form 102 before the cement is poured; in which case the cement forms to the contour of the abutting surfaces of the temporary cover as it is poured. By forming the wet cement 100 to the abutting surfaces of the temporary cover 10, there are no voids between the temporary cover 10 and the cement 100. The temporary cover 10 remains installed in the stair throughout the construction period, acting as a temporary nosing to protect the stair.

After construction of the building is complete, the fasteners 40 are disengaged from the anchors 50 and removed from the holes 30. The base 20 may then be removed from the substrate 100 as shown by the arrow "R." The anti-stick compound 39 prevents the substrate and anchors from bonding to the base 20, thereby making it easier to remove the base 20 from the cement while leaving the anchors 50 fixedly imbedded in the substrate 100. Accordingly, the base 20 may be removed by prying it loose with a chisel or screwdriver without removing the anchors 50 or damaging the substrate.

One advantage of the temporary cover 10 is that it is an inexpensive cover that substitutes for a permanent cover during the construction of a building. The temporary cover 10 is installed during construction and left in place until construction is completed. After construction is completed, the base 20 is removed and replaced by a permanent cover. Thus, if damage happens to occur during construction, it is the base 20 of the temporary cover that is damaged instead of the permanent cover.

Figure 6:
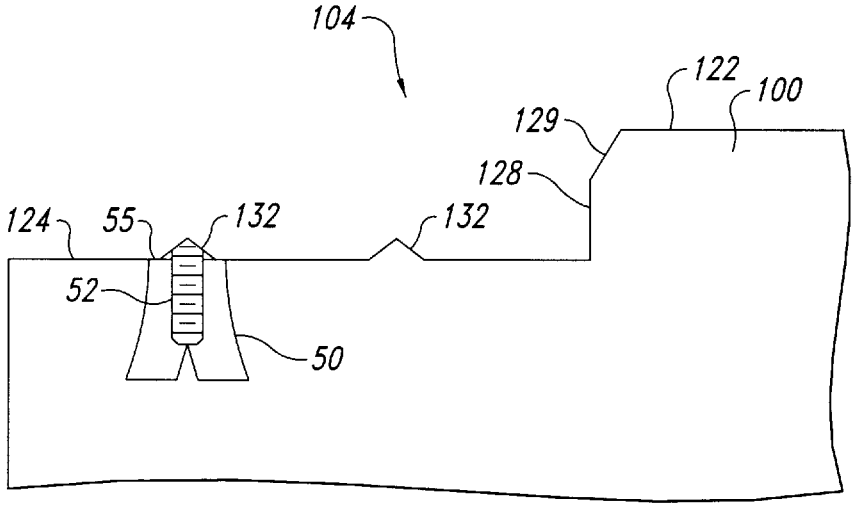
FIG. 6 is a cross-sectional view of a substrate and an anchor after a temporary cover in accordance with the invention has been removed.

Another advantage of the temporary cover 10 is that it prepares the substrate 100 to receive a permanent cover. The profile of the base 20 is selected to either form to or mate with a contoured region 104 in the substrate, and the contoured region 104 is configured to mate with the profile of the permanent cover. When the substrate is wet cement, the base 20 and anchors 50 are imbedded in the substrate so that the cement forms to the bottom face 24, rear face 28, lip 29, and anchor 50. Accordingly, as shown in FIG. 6, the contoured region 104 has a floor 124, a number ridges 132, a backwall 128, and a ledge 129. After construction is completed, the base 20 is removed from the substrate and the anchors 50, thus preparing the contoured region 104 and the anchors 50 for receiving the permanent cover.

Still another advantage of the temporary cover 10 is that it is readily available when contractors need it because it can be economically inventoried in large quantities. The prefabricated base 20 is much less expensive to manufacture than conventional aluminum nosings because it is made from less expensive materials, and it does not require the time and labor consuming steps of applying, shaping and curing the abrasive treads used in such nosings. Accordingly, distributors can keep large inventories of prefabricated members on hand, insuring ready availability when builders need the members for installation into wet concrete.

Figure 7:
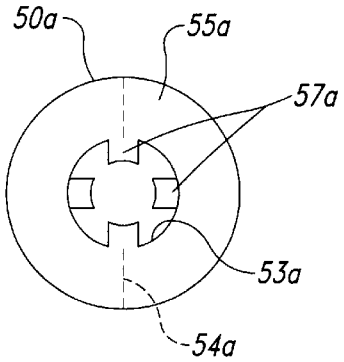
FIG. 7 is a top view of an anchor in accordance with the invention.
Figure 8:
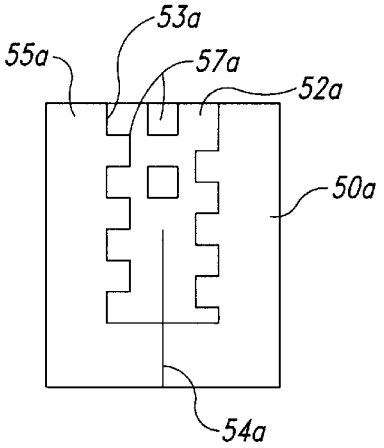
FIG. 8 is a cross-sectional view of the anchor of FIG. 7.
Figure 9:
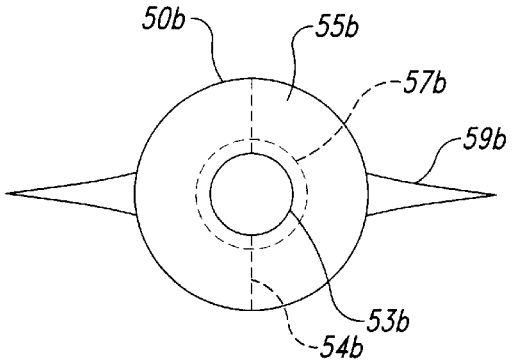
FIG. 9 is a top view of an alternative embodiment of an anchor in accordance with the invention.
Figure 10:
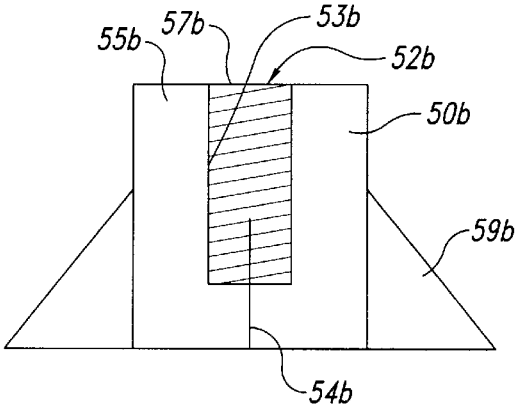
FIG. 10 is a cross-section view of the anchor of FIG. 9.

FIGS. 7 and 8 illustrate another embodiment 50*a* of an anchor. The anchor 50*a* has a recess 52*a* defined by an inner wall 53*a*. A number of protrusions 57*a* extend inwardly into the recess 52*a* for engaging the lower portion 44 of the fastener 40. FIGS. 9 and 10 depict yet another embodiment of an anchor 50*b* having a recess 52*b* defined by an inner wall 53*b*. A number of threads 57*b* extend around the inner wall 53*b*. The anchor 50*b* also has a number of fins 59*b* for enhancing the attachment of the anchor 50*b* to the substrate 100.

Figure 11:
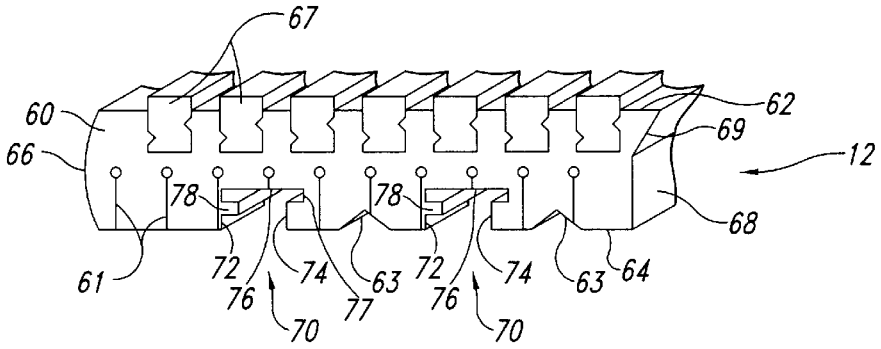
FIG. 11 is an isometric view of a permanent cover in accordance with the invention.

FIG. 11 further illustrates the permanent cover 12 that is used in conjunction with the temporary cover 10. The permanent cover 12 has a base element 60 with a number of high-friction tread members 67 mounted in its upper surface 62 as described in applicant's parent application U.S. Ser. No. 08/245,445. A number of slots 61 are positioned in the lower surface 64 of the base element 60. The base element 60 is made from a finished material such as extruded aluminum, and it is installed in the contoured region 104 after construction is substantially completed.

The permanent cover 12 has a selected profile as defined by the upper surface 62, lower surface 64, forward surface 66, and rear surface 68 of the base element 60. As with the base 20, the element 60 may have an inclined lip 69 extending upwardly at an angle from its rear surface 68 to its upper surface 62. The profile of the lower and rear surfaces of the permanent cover 12 are designated to be compatible with, and often identical to, the profile of the bottom and rear faces of the temporary cover 10. A number of channels 70 are positioned in the bottom surface 64 of the element 60. Each channel 70 has sidewalls 72 and 74 that extend upwardly from the bottom surface 64 to an end wall 76. The end wall 76 is positioned below the upper surface 62 at an intermediate point in the interior of the element 60 so that no portion of the channel 70 is open to the upper surface 62. In a preferred embodiment, a slot 77 runs along the upper portion of sidewall 74 and a lip 78 runs along sidewall 72. A number of grooves 63 also extend along the length of the bottom surface 64.

Figure 12:
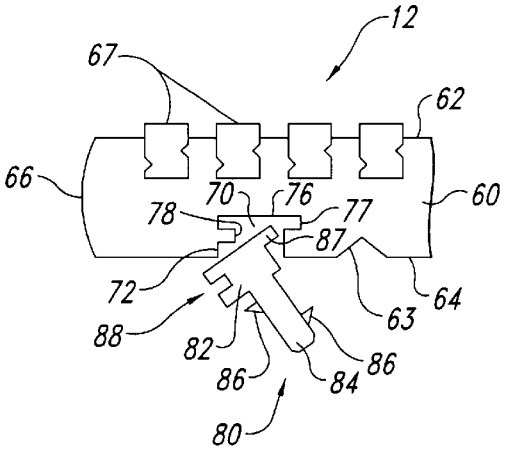
FIG. 12 is an end view of a permanent cover in accordance with the invention.
Figure 13:
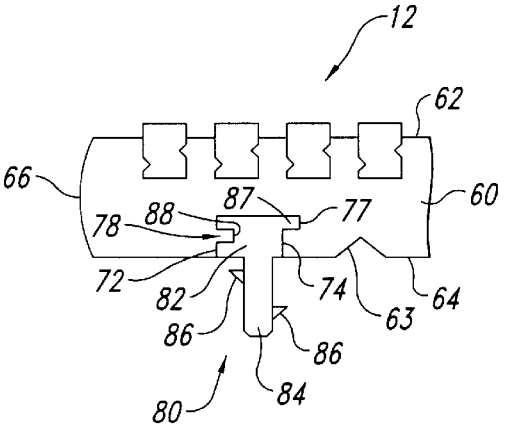
FIG. 13 is an end view of a permanent cover in accordance with the invention.

FIGS. 12 and 13 further show the fastener 80 in relationship to the element 60. The fastener 80 has a head 82 and a stud 84 extending from its head. In a preferred embodiment, a means for locking the head 82 to the channel is included on the head 82 and the sidewalls 72 and 74 of the channel. The locking means may include a lip 87 and a notch 88 positioned on the head 82, and the lip 78 and the slot 77 in the channel 70. To attach the fastener 80 to the element 60, the lip 87 is initially positioned in the channel 70 so that it is received in the slot 77. As the head 82 is pivoted in the channel 70, the head 82 engages the lip 78 on the sidewall 72. The fastener 80 is pivoted in the channel 70 until the lip 78 is received in the notch 88. The lip 78 may be a deformable protrusion that deforms as it is engaged by the head 82 and then springs at least partly back into its original position as it is received in the notch 88. Other embodiments of the head 82 may allow it to be inserted at the end of the channel 70 and slid along the length of the channel 70 to a selected position. In any of the embodiments, the fastener 80 is positioned in the channel at a selected position that corresponds to the position of the holes 30 in the base 20.

Figure 14:
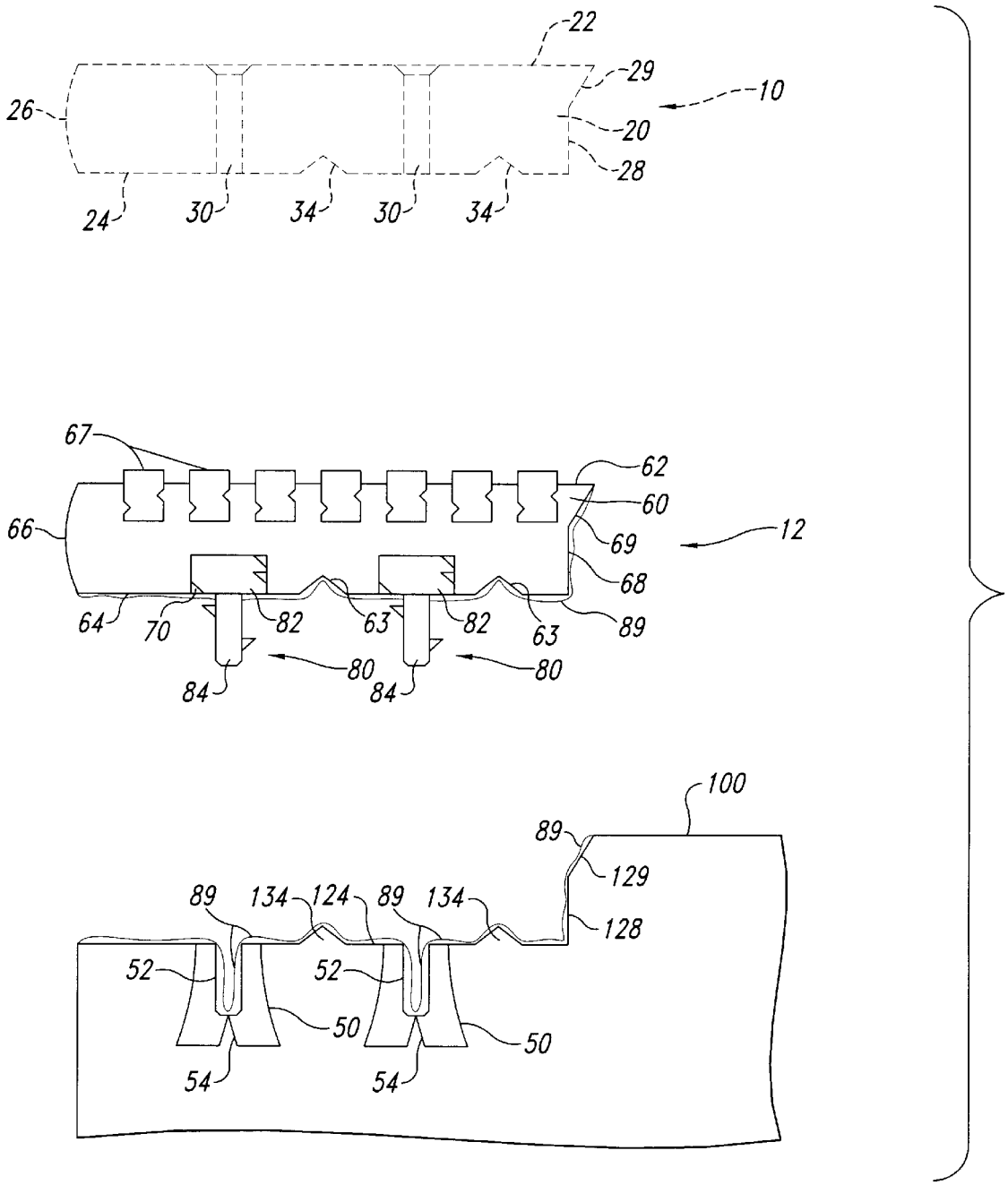
FIG. 14 is a cross-sectional view of a permanent cover in accordance with the invention being attached to a substrate.

FIG. 14 further illustrates the relationship between the temporary cover 10 and the permanent cover 12. The channels 70 are aligned with the holes 30, and the grooves 63 of the element 60 are aligned with the channels 34 of the base 20. The selected profiles of the element 60 and the base 20 are the same for those portions that contact the contoured region 104, thus allowing the element 60 to mate with a contoured region 104 formed by the base 20.

In operation, the fasteners 80 are selectively positioned along the channels 70 in alignment with the anchors 50 by laying the element 60 upside down next to the contoured region 104 and marking the positions of the recesses 52 on the element 60. The selected positions along the channels 70 may also be determined by placing the base 20 over the lower surface 64 and marking the positions of the holes 30 on the channels because the holes 30 are designed to be aligned with the channels 70. The fasteners 80 are then snapped into position and an adhesive or bonding compound 89 is spread over the contoured region 104, recesses 52, and anchors 50. The adhesive 89 is preferably an epoxy, and it is preferably deposited into the recesses 52 as it is spread. The permanent cover 12 is lowered against the substrate 100 so that the studs 84 are positioned in the recesses 52 of their corresponding anchors 50. A number of barbs 86 may be positioned on each stud 84 to enhance the attachment of the fasteners 80 to the anchors 50. When the permanent cover 12 is fully positioned in the contoured region 104, the bottom surface 64 abuts the floor 124, the grooves 63 abut the ridges 134, the rear surface 68 abuts the rear wall 128, and the inclined lip 69 abuts the incline surface 129. Accordingly, there are no voids between the abutting surfaces of the permanent cover 12 and the substrate 100.

While the detailed description above has been expressed in terms of a specific example, those skilled in the art will appreciate that may other variations could be used to accomplish the purpose of the disclosed invention. Accordingly, it can be appreciated that various modifications of the above-described embodiments may be made without departing from the spirit and the scope of the invention. Therefore the spirit and the scope of the present invention is to be limited only by the following claims.

I claim:

1. A protective cover in combination with a substrate, comprising:

an anchor having a recess, the anchor being embedded into the substrate having a contoured region; and a permanent cover affixed to the substrate, the permanent cover having a finished element composed of a metal and a fastener, the element having an upper surface, a lower surface, a channel extending along at least a portion of the lower surface, and a profile mated with the contoured region, the fastener having a non-exposed head positioned in the channel and a stud extending beyond the lower surface, the fastener being selectively positioned in place in the channel to align the stud with the recess of the anchor when the anchor is embedded in the substrate, the stud being positioned in the recess and the element being bonded to the substrate to permanently attach the permanent cover to the substrate.

2. A protective cover in combination with a cement substrate, comprising:

an anchor having a recess, the anchor being embedded into the cement substrate while the substrate is in a flowable state prior to being cured; and a temporary cover positioned on the cement substrate while the substrate is in a flowable state prior to being cured, the temporary cover having a base composed of a plastic material and a fastener, the base having a top face, a bottom face, and a selected profile to define a contoured region in the substrate while the substrate is in a flowable state prior to being cured, the fastener having an upper portion coupled to the base and a lower portion extending beyond the bottom face and engaged with the recess in the anchor, the first fastener being removably attachable to the anchor to removably attach the temporary cover to the substrate for a temporary protection period and then remove the temporary cover from the substrate for exposing the contoured region of the substrate after the temporary protection period.

3. The cover of claim 2 wherein the temporary cover further comprises a hole through the base extending from the top face to the bottom face, the upper portion of the first fastener being positioned in the hole.

4. The cover of claim 2 wherein the lower portion of the first fastener is threadedly attached to the anchor during the temporary protection period.

5. The cover of claim 2 wherein the temporary cover further comprises a plurality of holes, a number of first fasteners and a number of anchors, wherein each first fastener is positioned in a hole and each anchor is attached to a corresponding first fastener.

6. The cover of claim 2 wherein the temporary cover further comprises a high friction tape on the top face.

7. The cover of claim 2 wherein serrated treads are formed on the top face of the temporary cover.

8. The cover of claim 2 wherein the temporary cover further comprises an anti-stick compound on the bottom face.

9. The cover of claim 1 wherein the permanent cover further comprises means for locking the head into the channel at the selected location.

10. The cover of claim 9 wherein the locking means comprises a notch in the head and a mating lip extending along a sidewall of the channel, the lip allowing the head to pass into the channel under force until the lip mates with the notch.

11. The cover of claim 9 wherein the locking means comprises a notch in the head and a mating deformable protrusion on a sidewall of the channel, the protrusion deforming as the head is pressed into the channel allowing the head to pass into the channel until the protrusion mates with the notch.

12. The cover of claim 1 wherein serrated treads are formed on the top face of the permanent cover.

13. The cover of claim 1 wherein the permanent cover further comprises high friction treads along the upper surface.

* * * * *